US009655459B1

(12) United States Patent
Peng

(10) Patent No.: US 9,655,459 B1
(45) Date of Patent: May 23, 2017

(54) COLLAPSIBLE OAR COLLECTION DEVICE

(71) Applicant: I-Sin Peng, Taichung (TW)

(72) Inventor: I-Sin Peng, Taichung (TW)

(73) Assignee: I-sin Peng, Taichung (TW)

( * ) Notice: Subject to any disclaimer, the term of this patent is extended or adjusted under 35 U.S.C. 154(b) by 0 days.

(21) Appl. No.: 15/210,911

(22) Filed: Jul. 15, 2016

(51) Int. Cl.

| | |
|---|---|
| ***B65D 85/20*** | (2006.01) |
| ***A47F 7/00*** | (2006.01) |
| ***A47F 5/00*** | (2006.01) |
| ***B65D 71/50*** | (2006.01) |

(52) U.S. Cl.
CPC ..... *A47F 7/0021* (2013.01); *A47F 5/0006* (2013.01); *B65D 71/50* (2013.01)

(58) Field of Classification Search
CPC ..... A47F 5/0006; A47F 7/0021; B65D 25/28; B65D 71/50; B63H 16/073
USPC .... 206/150, 151, 315.1, 349, 577, 579, 806; 211/60.1, 70.6; 248/200, 251, 309.1; 440/104, 106–109; 294/87.2
See application file for complete search history.

(56) References Cited

U.S. PATENT DOCUMENTS 2,996,329 A * 8/1961 Glazer ..... B65D 71/50 206/145
4,244,542 A * 1/1981 Mathews ..... F16L 3/222 138/112
4,643,302 A * 2/1987 Baumgardner ..... A45C 3/00 190/105
5,346,271 A * 9/1994 Erickson ..... B65D 71/50 206/151
5,480,204 A * 1/1996 Erickson ..... B65D 71/50 206/151
6,334,531 B1 * 1/2002 Valkovich ..... B65D 71/50 206/163
6,837,472 B1 * 1/2005 Beutz ..... A45F 3/16 224/148.4
7,147,100 B1 * 12/2006 Borg ..... B65D 67/02 206/150

* cited by examiner

*Primary Examiner* — Luan K Bui
(74) *Attorney, Agent, or Firm* — Yuwen Guo

(57) ABSTRACT

A collapsible oar collection device is used for collecting a first collapsible section and a second collapsible section of a collapsible oar. The first collapsible section and the second collapsible section are detachably connected with each other to form the collapsible oar. The collection device comprises a first collection member and a second connection member. Since the fourth buckling element is buckled the second rod of the collapsible section so as to moved up and down, the collection device of the present invention may be applied to the collapsible oar with various diameters and aligned with the bottom ends of the first collapsible section and the second collapsible section with different lengths for housing in. Besides, the suspending rod is used for providing the display card to be detachably suspended and displayed. Therefore, the collapsible oar may be suspended and convenient to display simultaneously.

6 Claims, 6 Drawing Sheets

COLLAPSIBLE OAR COLLECTION DEVICE

FIELD OF THE INVENTION

The present invention provides an oar, more particularly to a collapsible oar collection device.

BACKGROUND OF THE INVENTION

The conventional oar collection device may include a first connection member and a second connection member. Two ends of the first connection member may be respectively and detachably connected to a first section and a second section after being collapsing an oar. One end of the second connection member is a first cap for covering and being fastened at the top end of the first section and the other end thereof is a second cap for covering and being fastening at the top end of the second section.

A hook ring is further extended from the top end of the second connection member upwardly. An axial direction of the hook ring is parallel to an axial direction of the second connection member.

However, since the first cap and the second cap of the second connection member are respectively covered the top ends of the first section and the second section and the lengths of the first section and the second section are different, the bottom ends of the first section and the second section may be not aligned with each other and influence the appearance of housing in the oar.

In addition, since the hook ring may not suspend the display card while the hook ring is suspended at a hook, another member may be necessary to provide to fix the display card. It is inconvenient.

SUMMARY OF THE INVENTION

An objective of this invention is providing a collapsible oar collection device. Since the fourth buckling element is buckled the second rod of the collapsible section so as to moved up and down, the collection device of the present invention may be applied to the collapsible oar with various diameters and aligned with the bottom ends of the first collapsible section and the second collapsible section with different lengths for housing in. Besides, the suspending rod is used for providing the display card to be detachably suspended and displayed. Therefore, the collapsible oar may be suspended and convenient to display simultaneously.

To achieve above objectives, a collapsible oar collection device may be used for collecting a first collapsible section and a second collapsible section of a collapsible oar. The first collapsible section and the second collapsible section are detachably connected with each other to form the collapsible oar. The collection device may be cooperated with a first collection member. The first collection member may have a first buckling element, a first connecting section, and a second buckling element, two ends of the first connecting section are respectively connected to the first buckling element and the second buckling element, the first buckling element and the second buckling element are respectively and detachably connected to a first rod of the first collapsible section and a second rod of the second collapsible section. The collection device may be a second collection member, having a third buckling element, a second connecting section, a fourth buckling element, a hooking element, a reinforcing rod, and a suspending rod, two ends of the second connecting section are respectively connected to the third buckling element and the fourth buckling element, the hooking element is extended upwardly from a location of the second connecting section arranged between the third buckling element and the fourth buckling element, a width direction of the hooking element is parallel to a length direction of the second connecting section, the third buckling element is detachably connected to the first rod of the first collapsible section and arranged above the first buckling element, the fourth buckling element is buckled the second rod of the second collapsible section so as to move up and down and arranged above the second buckling element, two ends of the reinforcing rod are respectively connected to a side of the third buckling element and a side of the fourth buckling element which are faced to each other, and two ends of the suspending rod are respectively connected to the side of the third buckling element and the side of the fourth buckling element which are faced to each other and arranged under the reinforced rod.

In some embodiments, the first buckling element, the second buckling element, the third buckling element, and the fourth buckling element are C-ring.

In some embodiments, the first connecting section is I-shaped, and the second connecting section is U-shaped.

In some embodiments, the hooking element includes a suspending hole.

In some embodiments, the suspending hole is elongated and a length direction of the suspending hole is parallel to the width direction of the hooking element.

In some embodiments, a projection of the reinforcing rod projected downwardly is parallel to a projection of the suspending rod projected downwardly but not overlapped.

Further features and advantages of the present invention will become apparent to those of skill in the art in view of the detailed description of preferred embodiments which follows, when considered together with the attached drawings and claims.

BRIEF DESCRIPTION OF THE DRAWINGS

All the objects, advantages, and novel features of the invention will become more apparent from the following detailed descriptions when taken in conjunction with the accompanying drawings.

DESCRIPTION OF THE PREFERRED EMBODIMENT

Figure 1:
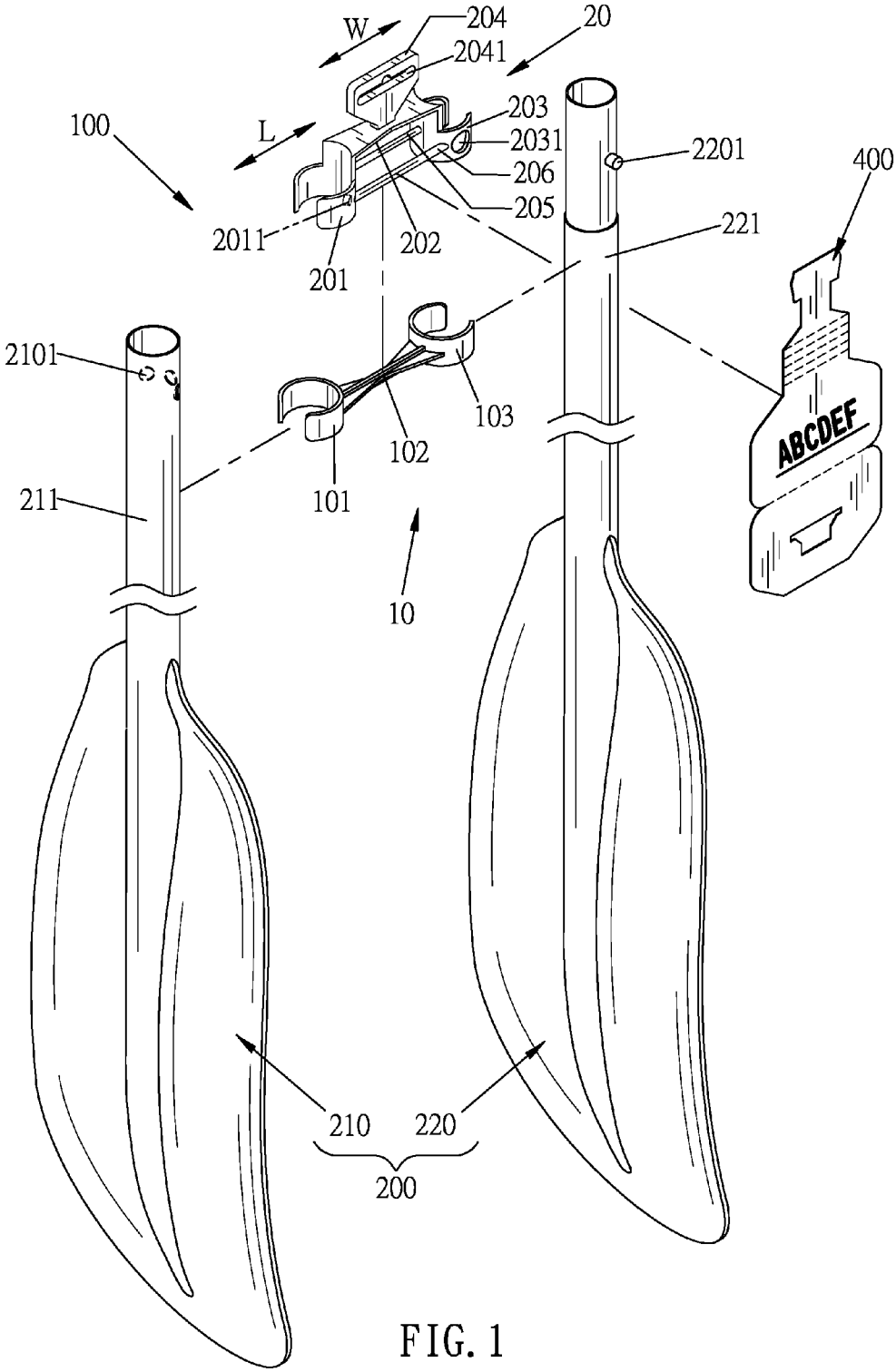
FIG. 1 is an exploded view of a collapsible oar collection device according to present invention.
Figure 2:
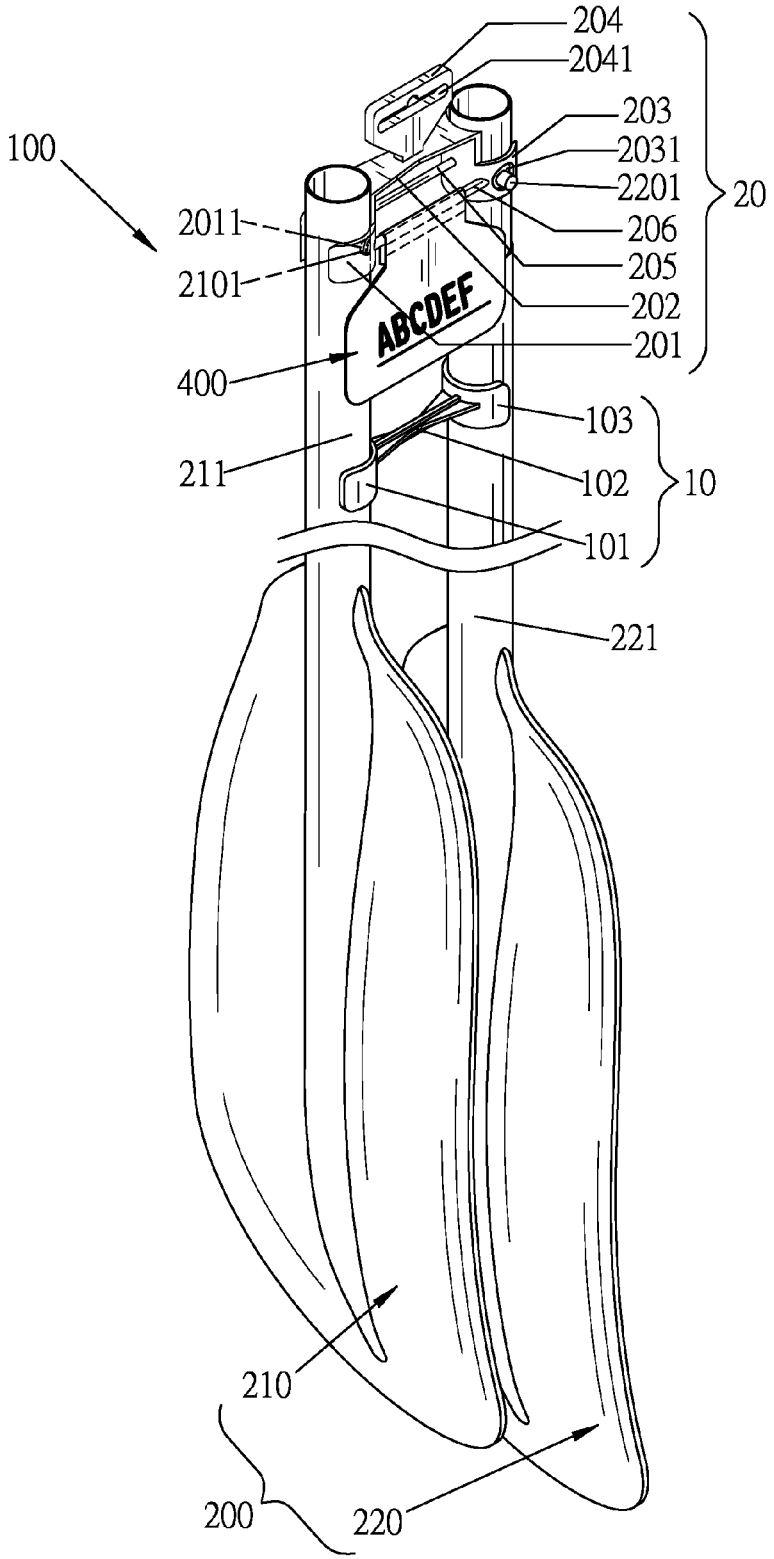
FIG. 2 is a perspective view of the collapsible oar collection device according to present invention.

Referring now to the drawings where like characteristics and features among the various figures are denoted by like reference characters.

Please refer to FIGS. 1 to 6, a collapsible oar collection device 100 is used for collecting a first collapsible section 210 and a second collapsible section 220 of a collapsible oar 200. The first collapsible section 210 and the second collapsible section 220 are detachably connected with each other to form the collapsible oar 200.

The collection device 100 may be cooperated a first collection member 10.

The first collection member 10 may have a first buckling element 101, a first connecting section 102, and a second buckling element 103. Two ends of the first connecting section 102 are respectively connected to the first buckling element 101 and the second buckling element 103. The first buckling element 101 and the second buckling element 103 are respectively and detachably connected to a first rod 21 of the first collapsible section 210 and a second rod 221 of the second collapsible section 220.

The collection device 100 may be a second collection member 20 which may have a third buckling element 201, a second connecting section 202, a fourth buckling element 203, a hooking element 204, a reinforcing rod 205, and a suspending rod 206. Two ends of the second connecting section 202 are respectively connected to the third buckling element 201 and the fourth buckling element 203. The hooking element 204 is extended upwardly from a location of the second connecting section 202 arranged between the third buckling element 201 and the fourth buckling element 203. A width direction (an arrow W in FIG. 1) of the hooking element 204 is parallel to a length direction (an arrow L in FIG. 1) of the second connecting section 202. The third buckling element 201 is detachably connected to the first rod 211 of the first collapsible section 210 and arranged above the first buckling element 101. The fourth buckling element 203 is buckled the second rod 221 of the second collapsible section 220 so as to move up and down and arranged above the second buckling element 103. Two ends of the reinforcing rod 205 are respectively connected to a side of the third buckling element 201 and a side of the fourth buckling element 203 which are faced to each other for reinforcing the strength of the second connecting section 202, and two ends of the suspending rod 206 are respectively connected to the side of the third buckling element 201 and the side of the fourth buckling element 203 which are faced to each other and arranged under the reinforced rod 205 for providing to detachably suspend a display card 400. In detail, a projection of the reinforcing rod 205 projected downwardly is parallel to a projection of the suspending rod 206 projected downwardly but not overlapped.

The third buckling element 201 may have an inner post 2011 and the fourth buckling element 203 may have a through hole 2031. One end of the first collapsible section 210 has a through hole 2101 and one end of the second collapsible section 220 has an foldable post 2201. The inner post 2011 may be detachably cooperated with the through hole 2101 and the foldable post 2201 may be detachably cooperated with the through hole 2031. It may make the first collapsible section 210 and the second collapsible section 220 to be fastened to the third buckling element 201 and the fourth buckling element 203 respectively.

In addition, the hooking element 204 has a suspending hole 2041. Preferably, the suspending hole 2041 is elongated. A length direction of the elongated suspending hole 2041 is parallel to the width direction (the arrow W in FIG. 1) of the hooking element 204.

Preferably, the first buckling element 101, the second buckling element 103, the third buckling element 201, and the fourth buckling element 203 are C-ring for cooperating with the first rod 211 and the second rod 221 with various diameters. The first connecting section 102 is I-shaped and the second connecting section 202 is U-shaped.

Please reference to FIGS. 3 to 6, since the oar 200 has different diameters relative to different brands and purposes, the diameters of the first rod 211 and the second rod 221 are different. The first buckling element 101, the second buckling element 103, and the third buckling element 201 are C-ring for cooperating with the first rod 211 and the second rod 221 with various diameters by the elasticity of the C-ring. The size of the fourth buckling element 203 may be different according to the diameters of the first rod 211 and the second rod 221. Therefore, the collection device 100 of the present invention may collect the first rod 211 and the second rod 221 of the oar 200 together. Since the fourth buckling element 203 is buckled the second rod 221 of the collapsible section 220 so as to moved up and down, the collection device 100 of the present invention may be applied to the collapsible oar 200 with various diameters and aligned with the bottom ends of the first collapsible section 210 and the second collapsible section 220 with different lengths for housing in.

Figure 3:
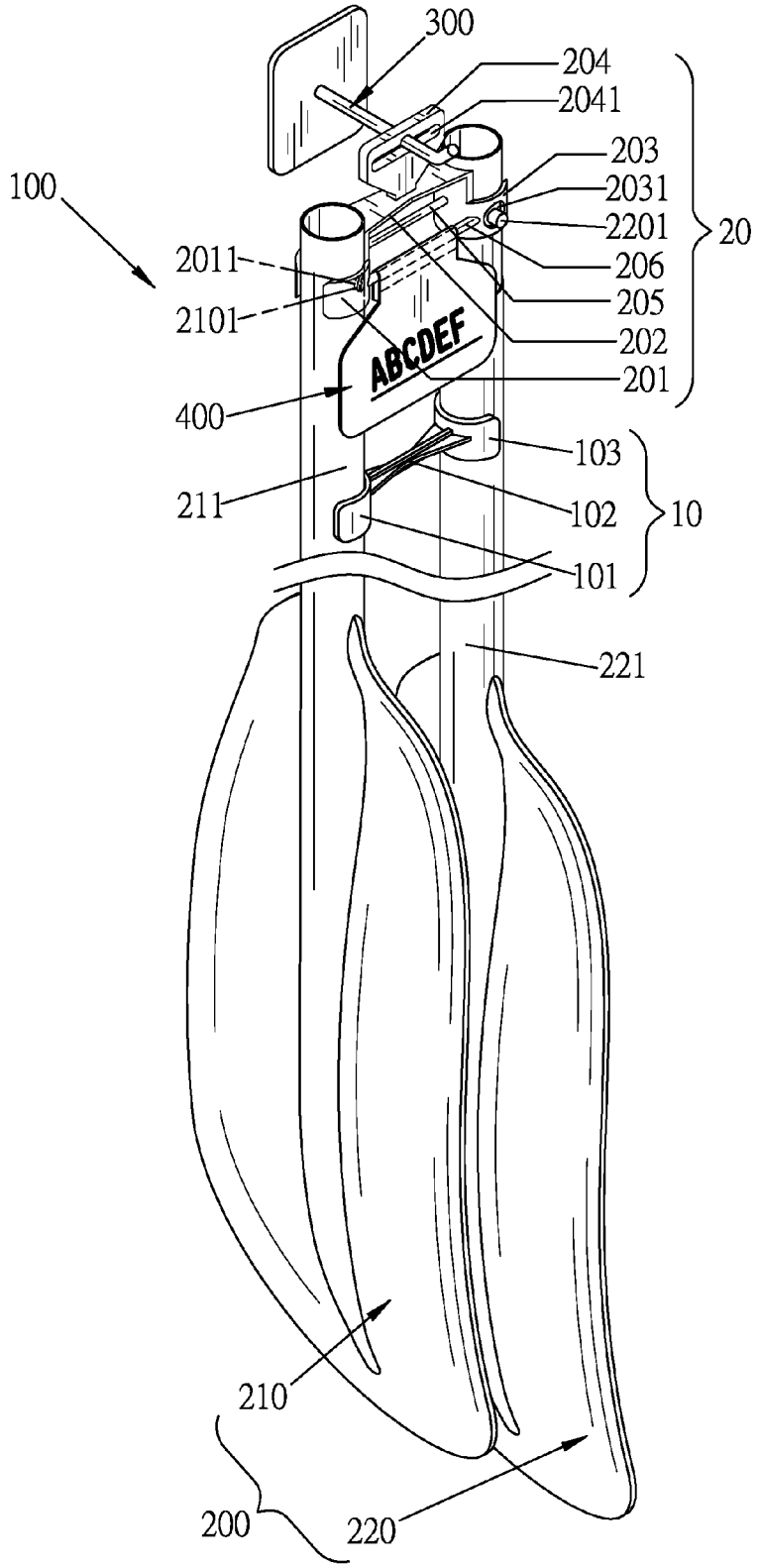
FIG. 3 is a view of the collapsible oar collection device according to present invention suspended to a hook while the first rod and second rod have smaller diameters.
Figure 4:
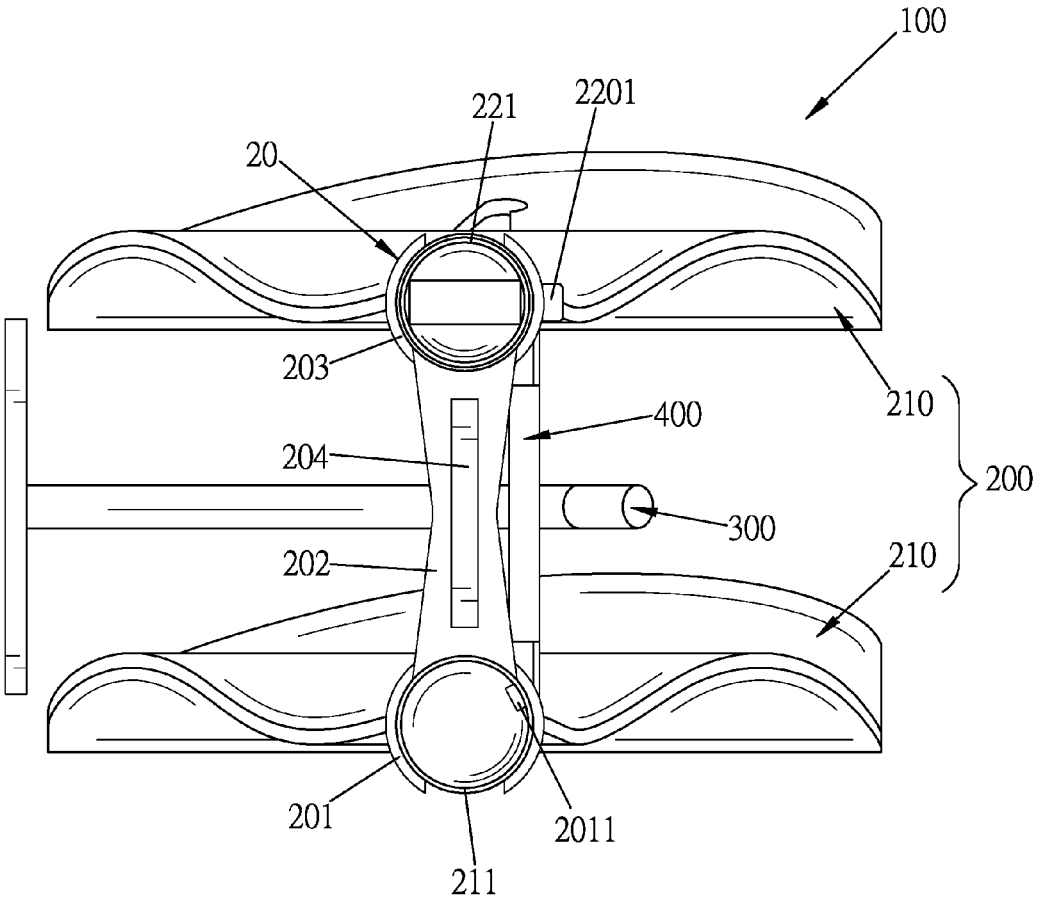
FIG. 4 is a top view of FIG. 3.
Figure 5:
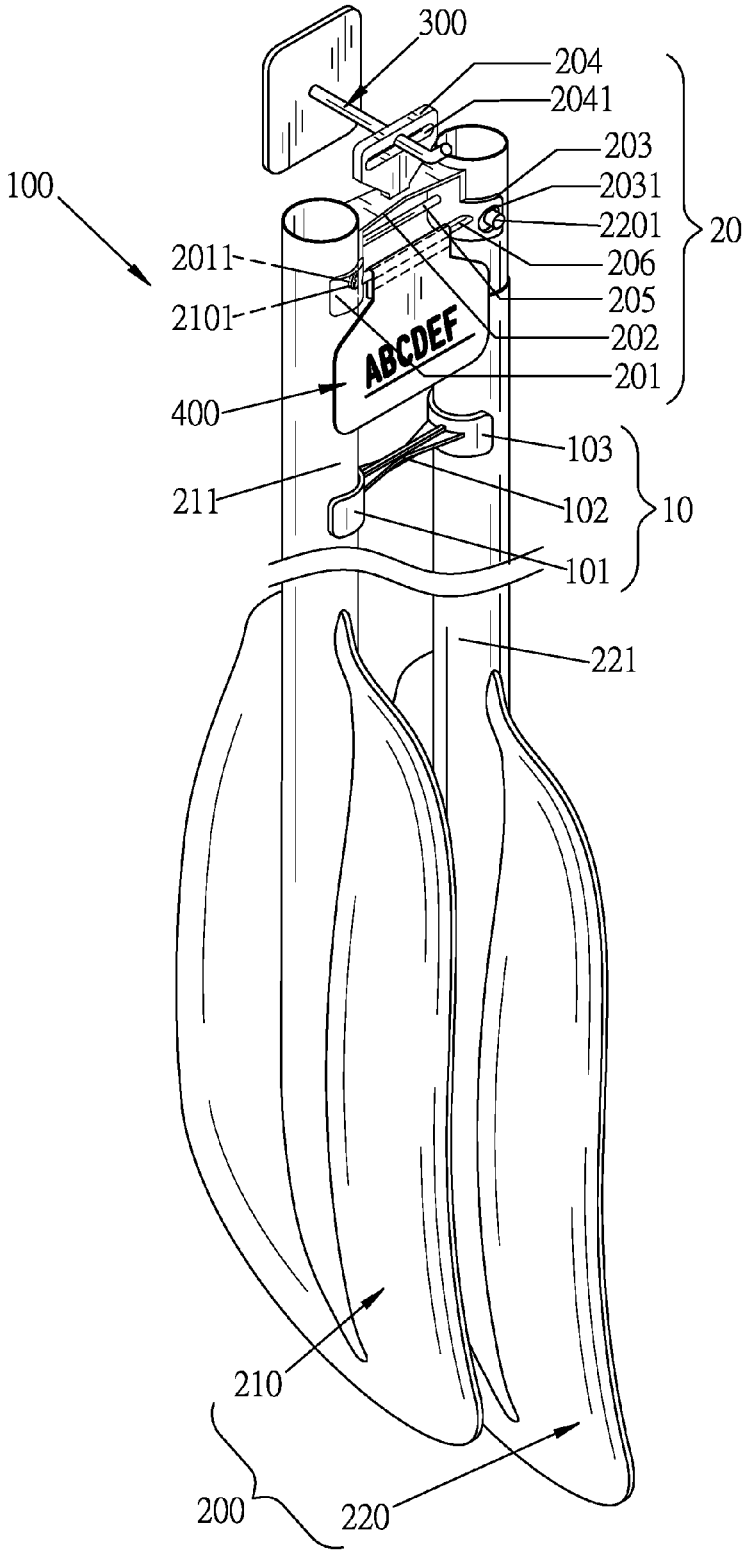
FIG. 5 is a view of the collapsible oar collection device according to present invention suspended to a hook while the first rod and second rod have larger diameters.
Figure 6:
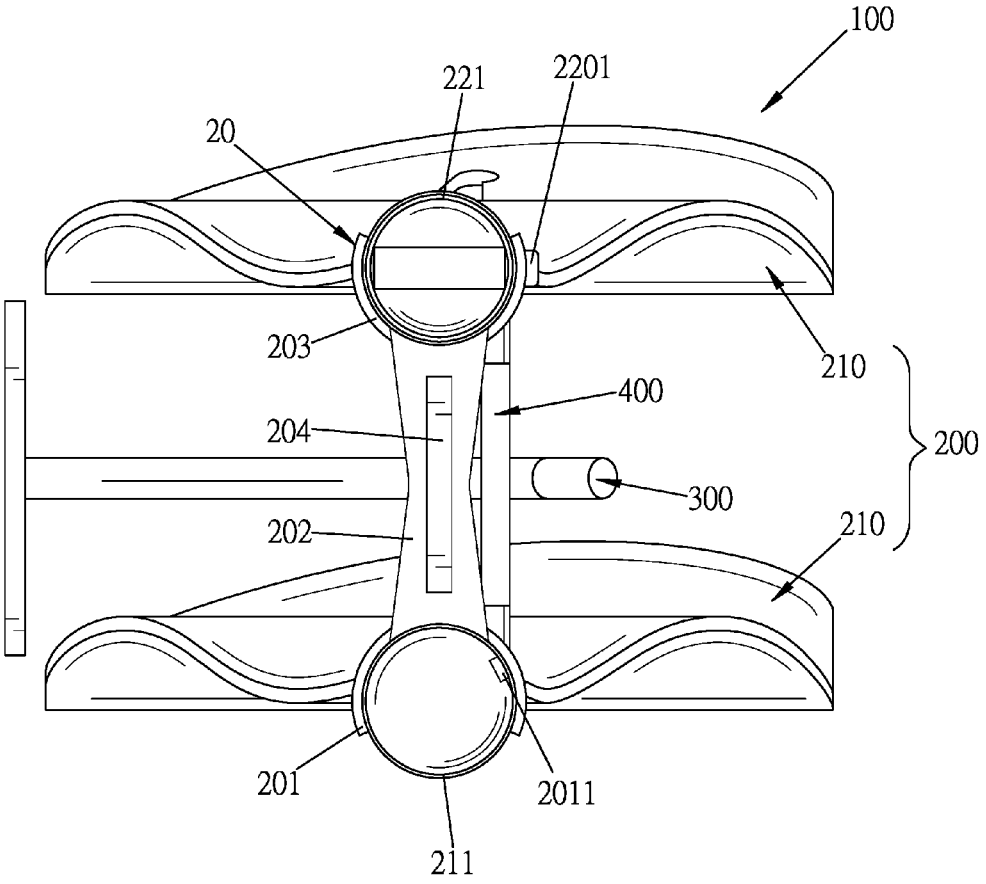
FIG. 6 is a top view of FIG. 5.

Besides, please refer to FIGS. 3 and 4. In FIG. 3, a hook 300 is passed through the suspending hole 2041 so that the first collapsible section 210 and the second collapsible section 220 of the collapsible oar 200 may be spaced apart from each other and arranged at right and left for each. At the same time, the suspending rod 206 is used for providing the display card 400 to be detachably suspended and displayed. Therefore, the collapsible oar 200 may be suspended and convenient to display simultaneously.

What is claimed is:

1. A collapsible oar collection device, collecting a first collapsible section and a second collapsible section of a collapsible oar, the first collapsible section and the second collapsible section are detachably connected with each other to form the collapsible oar, the collection device is cooperated with a first collection member, the first collection member has having a first buckling element, a first connecting section, and a second buckling element, two ends of the first connecting section are respectively connected to the first buckling element and the second buckling element, the first buckling element and the second buckling element are respectively and detachably connected to a first rod of the first collapsible section and a second rod of the second collapsible section, the collection device comprising:

a second collection member, having a third buckling element, a second connecting section, a fourth buckling element, a hooking element, a reinforcing rod, and a suspending rod, two ends of the second connecting section are respectively connected to the third buckling element and the fourth buckling element, the hooking element is extended upwardly from a location of the second connecting section arranged between the third buckling element and the fourth buckling element, a width direction of the hooking element is parallel to a length direction of the second connecting section, the third buckling element is detachably connected to the first rod of the first collapsible section and arranged above the first buckling element, the fourth buckling element is buckled the second rod of the second collapsible section so as to move up and down and arranged above the second buckling element, two ends of the reinforcing rod are respectively connected to a side of the third buckling element and a side of the fourth buckling element which are faced to each other, and two ends of the suspending rod are respectively connected to the side of the third buckling element and the side of the fourth buckling element which are faced to each other and arranged under the reinforced rod.

2. The collapsible oar collection device as claimed in claim 1, wherein the first buckling element, the second buckling element, the third buckling element, and the fourth buckling element are C-ring.

3. The collapsible oar collection device as claimed in claim 1, wherein the first connecting section is I-shaped, and the second connecting section is U-shaped.

4. The collapsible oar collection device as claimed in claim 1, wherein the hooking element includes a suspending hole.

5. The collapsible oar collection device as claimed in claim 4, wherein the suspending hole is elongated and a length direction of the suspending hole is parallel to the width direction of the hooking element.

6. The collapsible oar collection device as claimed in claim 1, wherein a projection of the reinforcing rod projected downwardly is parallel to a projection of the suspending rod projected downwardly but not overlapped.

* * * * *